US006123060A

United States Patent [19]

Wild et al.

[11] Patent Number: 6,123,060

[45] Date of Patent: Sep. 26, 2000

[54] METHOD OF AVOIDING ERRONEOUS ANNOUNCEMENTS WHEN DIAGNOSING A TANK-VENTING SYSTEM OF A MOTOR VEHICLE

[75] Inventors: Ernst Wild, Oberriexingen; Werner Mezger, Eberstadt; Andreas Blumenstock, Ludwigsburg; Georg Mallebrein, Singen, all of Germany

[73] Assignee: Robert Bosch GmbH, Stuttgart, Germany

[21] Appl. No.: 09/190,294

[22] Filed: Nov. 13, 1998

[30] Foreign Application Priority Data

Nov. 13, 1997 [DE] Germany ..... 197 50 193

[51] Int. Cl.[7] ..... F02M 37/04

[52] U.S. Cl. ..... 123/520

[58] Field of Search ..... 123/516, 518, 123/519, 520

[56] References Cited

U.S. PATENT DOCUMENTS

| | | | |
|---|---|---|---|
| 4,137,882 | 2/1979 | Thornburgh | 123/520 |
| 4,831,992 | 5/1989 | Jundt et al. | 123/520 |
| 5,349,935 | 9/1994 | Mezger et al. | 123/520 |
| 5,398,661 | 3/1995 | Denz et al. | 123/520 |

FOREIGN PATENT DOCUMENTS 4239382 5/1994 Germany .

*Primary Examiner*—Thomas N. Moulis
*Attorney, Agent, or Firm*—Walter Ottesen

[57] ABSTRACT

The invention is directed to a method of avoiding an erroneous fault announcement when diagnosing a tank-venting system for a motor vehicle having an internal combustion engine. In the method a change in elevation is determined at which the motor vehicle is operated during the diagnosis and this change in elevation is considered in the determination of the diagnostic result.

9 Claims, 3 Drawing Sheets

METHOD OF AVOIDING ERRONEOUS ANNOUNCEMENTS WHEN DIAGNOSING A TANK-VENTING SYSTEM OF A MOTOR VEHICLE

FIELD OF THE INVENTION

The invention relates to a method of diagnosing a leak in a tank-venting system on the basis of an evaluation of the pressure difference between the interior of the tank-venting system and the ambient.

BACKGROUND OF THE INVENTION

U.S. Pat. No. 5,398,661 discloses a method of this kind which is based on an underpressure check. A method based on an overpressure check is disclosed in U.S. Pat. No. 5,349,935.

German patent publication 4,239,382 discloses that the diagnostic reliability for the check of the through-flow control valve is affected under specific operating conditions. The through-flow control valve controls the flow of fuel vapor from the tank-venting system to the intake manifold of the internal combustion engine. To ameliorate this condition, it is suggested in this patent publication to detect the absolute values and/or change of operating characteristic values which are relevant for the diagnosis and to compare the same to pregiven threshold values and to interrupt the diagnosis as may be necessary.

It has been shown that erroneous fault announcements (that is, those not based on leaks) can occur even in leakage diagnostic methods.

SUMMARY OF THE INVENTION

In view of the foregoing, it is an object of the invention to provide a method for diagnosing leaks in tank-venting systems so that the above-mentioned erroneous fault announcements do not occur.

The method of the invention is for avoiding an erroneous fault announcement when diagnosing a tank-venting system for a motor vehicle having an internal combustion engine. The method includes the steps of: determining a change in elevation at which the motor vehicle is operated during the diagnosis; and, considering the change in elevation in the determination of the diagnostic result.

The invention is based on the recognition that the diagnostic reliability for leakage diagnostic methods, which are based on difference pressure measurements, are affected when the ambient pressure fluctuates as a consequence of driving a vehicle upwardly in elevation and downwardly in elevation.

The tank is closed when diagnostic checks are made. The ambient pressure changes and therefore the pressure difference between the closed tank and the ambient changes when carrying out the diagnosis during a time of uphill and downhill travel. This can lead to an erroneous conclusion as to a leak. Uphill travel is critical for the underpressure method. The ambient pressure becomes less and leads to an increase of the pressure difference when there is a constant underpressure in the closed tank. This can be erroneously interpreted as a leak in the underpressure method. Ambient air flows into the tank through a leak and thereby reduces the tank underpressure.

Downhill travel is critical in the overpressure method. There, the increasing ambient pressure is erroneously indicated as a pressure drop and is therefore registered as a leak in the tank closed with overpressure.

According to the invention, a change in elevation (at which the motor vehicle is operated), which takes place during the diagnosis, is considered when evaluating the pressure change. A first embodiment compensates for the influence of the change in elevation when evaluating the difference pressure measurements. In this way, the advantage of increased diagnostic reliability is combined with maintaining the number of opportunities for conducting the diagnosis.

In a second embodiment, an interruption of the diagnosis takes place when the change in elevation exceeds a predetermined amount. In this embodiment, the advantage of a reduced complexity of the evaluation is associated with increased diagnostic reliability.

An advantageous simple possibility for detecting changes in elevation results from an evaluation of the signal of an ambient pressure sensor.

A further possibility to determine the changes in elevation results by evaluating operating characteristic variables of the motor vehicle which are anyway detected. In this way, in an advantages manner, a special elevation-change sensor/ambient pressure sensor can be omitted.

BRIEF DESCRIPTION OF THE DRAWINGS

The invention will now be explained with reference to the drawings wherein.

DESCRIPTION OF THE PREFERRED EMBODIMENTS OF THE INVENTION

Figure 1:
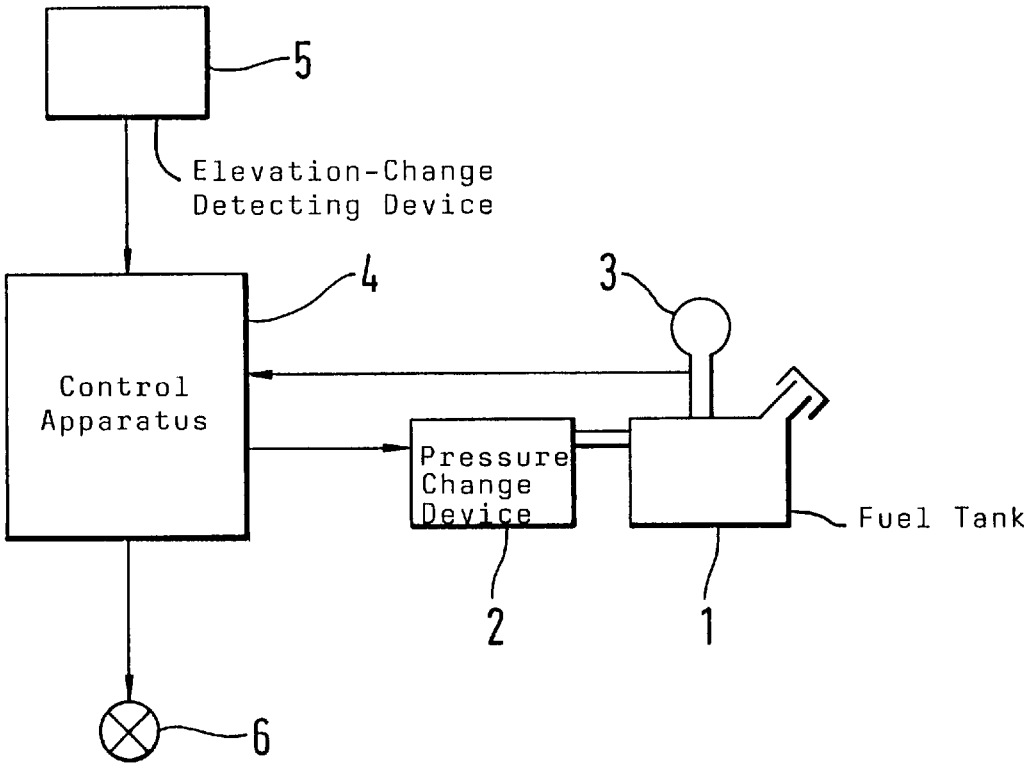
FIG. 1 is a schematic of a tank-venting system having diagnostic units and evaluation units of a motor vehicle.

Reference numeral 1 in FIG. 1 represents a fuel tank which is operatively connected to a device for changing the pressure in the fuel tank. The tank is shown here as representative for the tank-venting system. Changes of pressure in the tank are transmitted from a difference pressure sensor 3 to a control apparatus 4. The control apparatus, in addition, receives further signals from a device 5 which serves to determine the change of operating elevation of the motor vehicle.

The control apparatus 4 utilizes, via a connection to the pressure-change device 2, the adjustment of overpressure and underpressure in the tank-venting system for diagnostic purposes or controls the adjustment of pressure. Results of the diagnosis can be stored in the control apparatus and/or be displayed. For this purpose, a fault lamp 6 is provided in the embodiment of FIG. 1.

The device 2 for adjusting a pressure change can, for example, comprise the intake manifold of the engine in combination with a tank-venting valve. In this case, the tank-venting system is coupled to the intake manifold when a drive signal is applied to the tank-venting valve arranged between the tank-venting system and the intake manifold. The intake manifold pressure propagates immediately into the tank-venting system until the tank-venting valve is closed when a pregiven difference underpressure in the tank is reached.

Alternatively, the device for changing the pressure in the tank can also be realized as an overpressure pump which is driven by the control apparatus for generating a predetermined overpressure in the tank 1. The device 5 for determining a change in elevation can, for example, be realized as an ambient pressure sensor.

As an alternative, the device 5 can define one or several sensors for operating parameters of the motor vehicle which are anyway detected for the operation thereof. Examples of these operating parameters are the engine rpm and the load of the engine as well as a signal representing the distance travelled by the motor vehicle.

From these signals, the control apparatus 4 can likewise derive information as to a change of elevation. For example, in the control apparatus, a fuel-metering signal is conventionally formed from load and rpm of the engine. By summing the fuel-metering signal, the consumed fuel mass is formed and standardized by forming a quotient as to the travelled path. The fuel consumption formed in this manner defines a measure for the driving resistance at the actual vehicle speed. If the fuel consumption for a pregiven vehicle speed is less than a pregiven threshold, a conclusion is drawn as to uphill travel because the fuel consumption for downhill travel is less than for travel in the horizontal.

Figure 2:
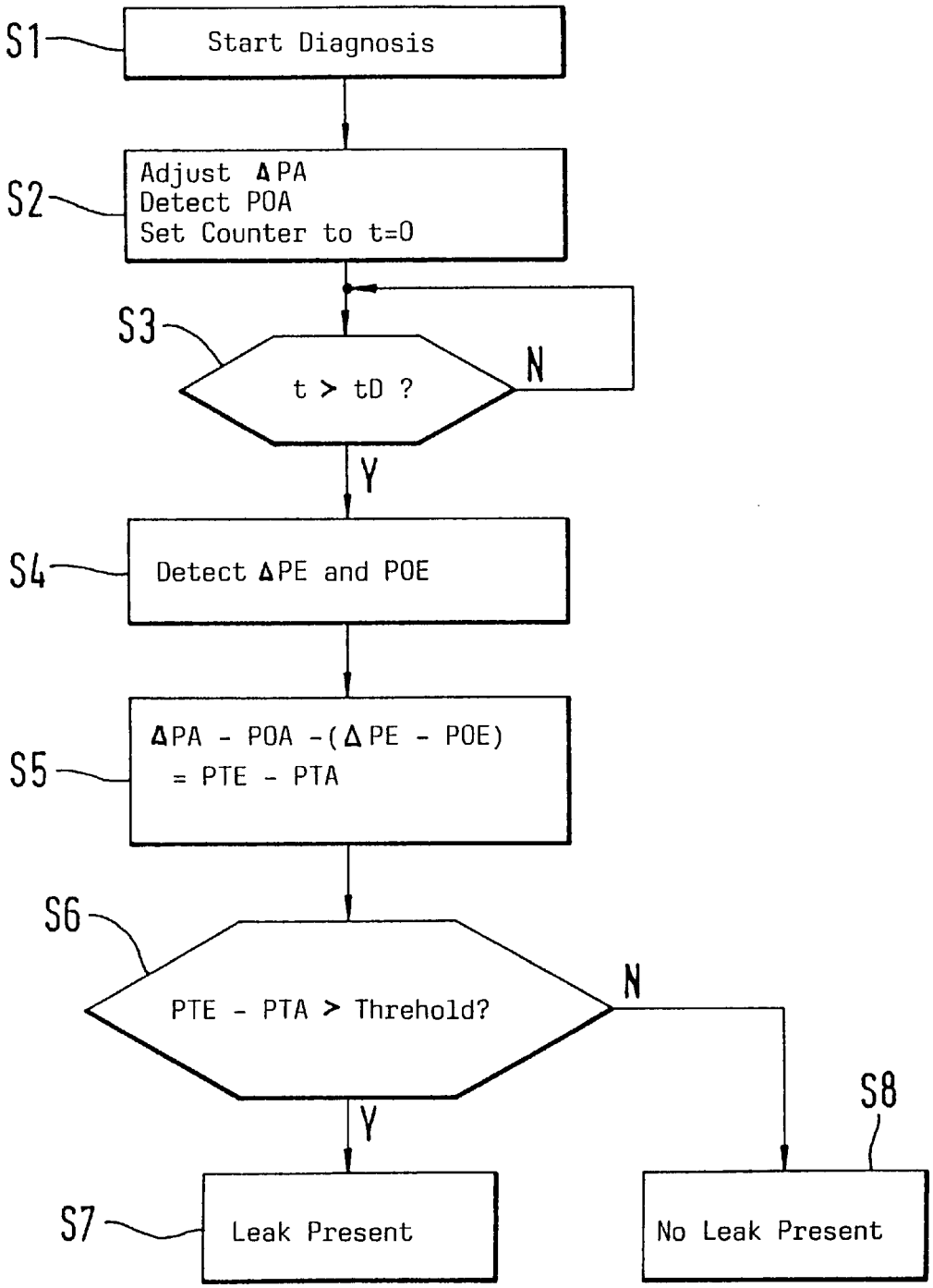
FIG. 2 is a flowchart showing a first embodiment of the method of the invention; and, FIG. 3 is another flowchart showing a second embodiment of the method of the invention.

FIG. 2 shows a first embodiment of the method of the invention wherein the influence of a change of elevation on the difference-pressure measurements is compensated. For this purpose, the diagnosis is started in a step S1. Then, in the tank or in the tank-venting system, a pregiven pressure difference ΔPA is adjusted to the ambient pressure by driving the device 2. At the same time, the ambient pressure P0A is detected by the device 5 and a counter is set to t=0.

In step S3, a check is made as to whether a pregiven waiting time tD has elapsed. This time tD is dimensioned in accordance with the time a leak of a pregiven size causes a detectable pressure change. After the elapse of this time, and in step S4, the difference pressure ΔPE at the end of the diagnostic method as well as the ambient pressure P0E at the end of the diagnostic method are detected. Thereafter, in step S5, the pressure difference is formed:

$$\Delta PA-P0A-(\Delta PE-P0E)=PTE-PTA.$$

Here, PTE defines the absolute pressure in the tank at the end of the diagnostic method and PTA defines the absolute pressure in the tank at the start of the diagnostic method. PTE and PTA are therefore independent of ambient pressure and therefore independent of ambient pressure fluctuations caused by changes in elevation. Stated otherwise, in this embodiment, the influence of elevation changes on the difference pressure measurements is eliminated by the difference formation in step S5.

In step S6, a comparison of the difference PTE−PTA to a pregiven threshold takes place. If the threshold is exceeded, then a conclusion as to a leak is made and a fault announcement "leak present" correspondingly follows in step S7. This fault announcement can be used directly or, if required, after being made safe by statistic evaluation of several measurements, to drive the fault lamp 6.

If, in contrast, in step S6, the threshold is not exceeded, then the tank-venting system or the tank is assumed to be tight. This result is evaluated in step S8 as "OK-announcement" and can be, for example, stored in the control apparatus.

Figure 3:
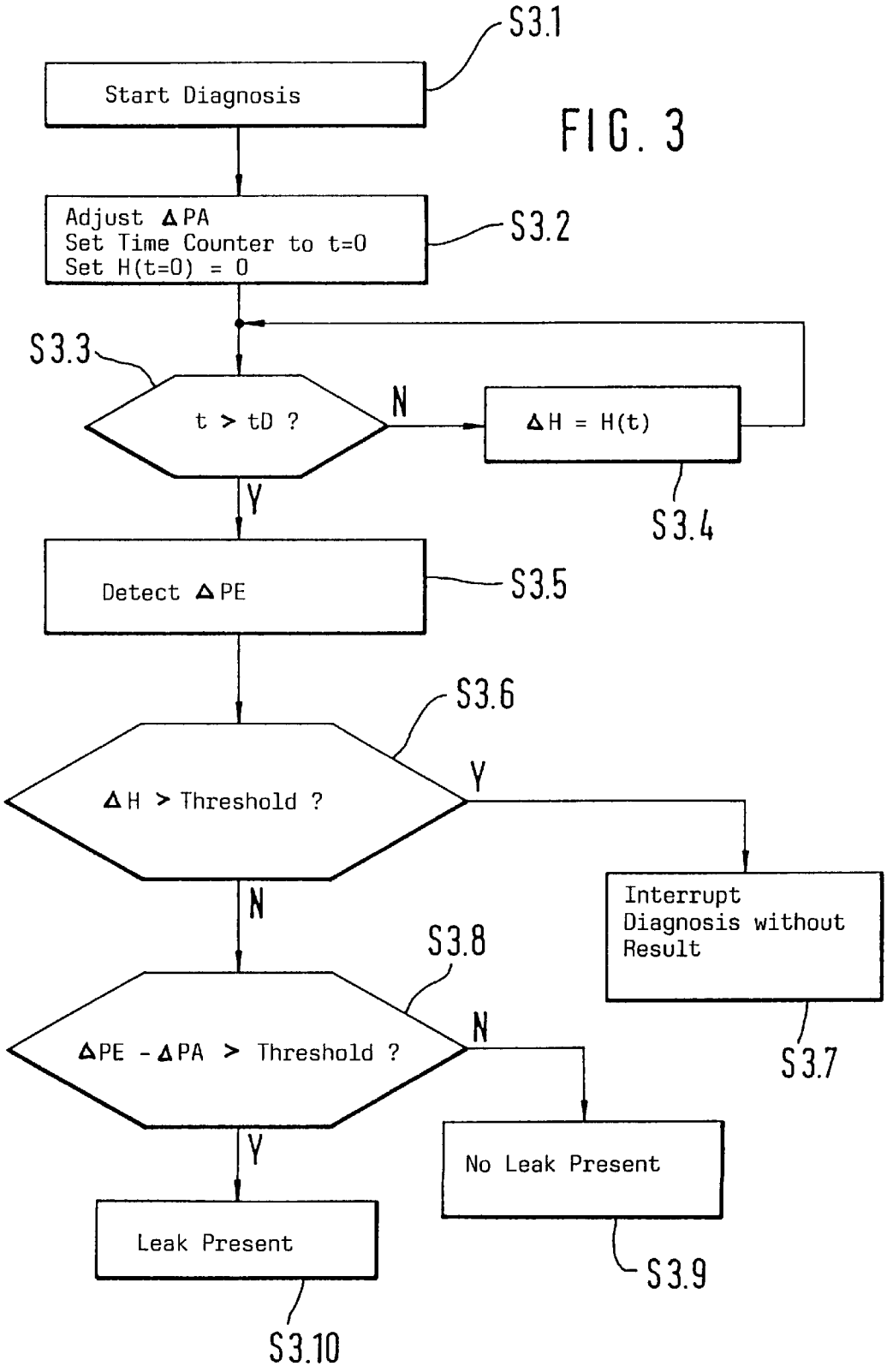

A second embodiment of the method of the invention is shown in FIG. 3. Here, after a start of the diagnosis in step S3.1, a difference pressure ΔPA between the interior of the tank-venting system and the ambient is adjusted in step S3.2 via a drive of the device 2. In addition, a time counter is set to t=0 and a quantity H(t) is set to 0. This quantity H(t) is a measure for changes in the elevation at which the motor vehicle operates.

In step S3.3, a check takes place as to whether the time (t) since the start of the diagnosis has exceeded the time tD which is necessary for a diagnosis. As long as this is not the case, a quantity ΔH=H(t) is formed in step 3.4 as a measure for the change in the elevation at which the motor vehicle operates since the start of the diagnosis. This quantity can be obtained by evaluating the signal of an ambient pressure sensor. In this case, H(t=0) is the ambient pressure at the time point of the start of the diagnosis. ΔH(t) is then the difference of the actual ambient pressure to the value of the ambient pressure at time point t=0. A positive ΔH shows a downhill travel.

The fuel consumption can be evaluated as an alternative to the evaluation of the signal of an ambient pressure sensor. This is based upon the fact that the fuel consumption for downhill travel is less than in the horizontal insofar as the speeds are comparable. In this case, H(t=0) is the fuel consumption in the horizontal to be expected for the actual speed. If ΔH=H(t) as the actual fuel consumption is less than H(t=0), then a conclusion is drawn as to downhill travel. The fuel consumption can then be computed in that the fuel-metering signal is integrated and standardized to the distance travelled. The fuel-metering signals are formed in the control apparatus from sensor signals such as load and rpm and are therefore present in the control apparatus. For this reason, these signals can be summed without great complexity. The travelled distance can be computed from a signal, which is supplied to the control apparatus, as to the vehicle speed and the elapsed time. If the fuel consumption is greater than that which is to be expected for the actual speed in the horizontal, then a conclusion is drawn as to uphill travel.

Another alternative to determine downhill travel results from an evaluation of the overrun operation times and/or the overrun operation rpms. In downhill travel, overrun operation phases are usually longer and more frequent than for driving in the horizontal. If the summed overrun operation time exceeds a threshold during the observed time frame (that is, the time duration of the diagnosis), then a conclusion is drawn as to downhill travel. Overrun operation is present when it is not the engine which drives the wheels but the wheels which drive the engine as typically occurs during downhill travel.

A simple possibility for determining overrun operation results from a detection of the closed position of the throttle flap switch. This view becomes more precise when the overrun rpm is also considered because, at higher overrun rpm, a higher engine braking action occurs whereby the overrun phase is shortened. Downhill travel can also be detected when, for example, the summed product of the overrun rpm and the overrun time exceeds a threshold. For a vehicle having an automatic transmission, a conclusion as to downhill travel can be drawn, as an alternative, from the summed time during which idle is present and a road speed which exceeds a threshold. A further alternative results from the evaluation of the activation time of a brake-light switch. If the summed time of the activated brake-light switch is greater than a threshold, then downhill travel is detected.

The embodiment shown in FIG. 3 is characterized by an interruption of the diagnosis when uphill travel or downhill travel is detected. For this purpose, the difference pressure ΔPE is detected at the end of the diagnostic time span tD in a step S3.5. In the next step S3.6, a check is made as to whether the quantity ΔH for an elevation change exceeds a threshold. As shown, the consumptions of fuel, the overrun operation times, or the activation times of the brake-light switch are considered. When the threshold is exceeded, the inquiry is answered in the affirmative and, in step S3.7, the diagnosis is interrupted without result. If, in contrast, the threshold is not exceeded, then a check takes place in step S3.8 as to whether the difference of the difference pressures ΔPE and ΔPA (that is, the difference pressures at the end and at the start of the diagnostic phase) exceed a threshold. If the difference is less than the threshold, the system is considered to be tight and an OK announcement is outputted in step S3.9, that is, this can be stored in the control apparatus (no leak is present).

On the other hand, that is, when the threshold is exceeded, a fault announcement is outputted in step S3.10. This fault announcement can be used directly or after confirmation by statistical evaluation of several measurements for controlling the fault lamp 6.

It is understood that the foregoing description is that of the preferred embodiments of the invention and that various changes and modifications may be made thereto without departing from the spirit and scope of the invention as defined in the appended claims.

What is claimed is:

1. A method of avoiding an erroneous fault announcement for a diagnosis of a tank-venting system for a motor vehicle having an internal combustion engine, the method comprising the steps of:

determining a change in elevation at which said motor vehicle is operated during said diagnosis; and, considering said change in elevation in the determination of the diagnostic result.

2. The method of claim 1, comprising the further steps of:

providing an ambient pressure sensor which outputs a signal; and, determining said change in elevation by evaluating said signal.

3. The method of claim 2, comprising the further step of interrupting said diagnosis when the determined change in elevation exceeds a predetermined threshold value or compensating the determined change in elevation when evaluating the pressure changes within said tank-venting system.

4. The method of claim 1, comprising the further step of recognizing said change in elevation by evaluating operating characteristic variables of said engine and said motor vehicle.

5. The method of claim 4, comprising the further step of detecting said change in elevation by evaluating the consumed fuel wherein the consumed fuel is determined with reference to a travelled distance and a check is made as to whether the determined consumed fuel lies within a pregiven bandwidth of consumed fuel typical for travel in a horizontal level and said diagnosis is interrupted when the determined consumed fuel lies outside of said pregiven bandwidth.

6. The method of claim 4, comprising the further step of determining said change in elevation when the summed overrun operation time exceeds a pregiven threshold within a viewing time frame.

7. The method of claim 6, comprising the further step of weighting said overrun operation time with the overrun operation rpm in advance of the summation of said overrun operation time.

8. The method of claim 4, comprising the further step of determining a change in elevation when the summed time, during which the engine is in idle and the road speed is above a predetermined threshold, exceeds a predetermined threshold within a viewing time frame.

9. The method of claim 4, comprising the further step of determining a change in elevation when the time of the activated brake light switch exceeds a predetermined threshold; and, said time being summed within an observing time frame.

* * * * *